US005722320A

United States Patent [19]

Meyer

[11] Patent Number: 5,722,320

[45] Date of Patent: Mar. 3, 1998

[54] METHOD AND APPARATUS FOR ALIGNING DIE STAMPING PRESS PLATENS

[75] Inventor: David Thomas Meyer, Greer, S.C.

[73] Assignee: Kemet Corporation, Greenville, S.C.

[21] Appl. No.: 764,578

[22] Filed: Dec. 13, 1996

[51] Int. Cl.[6] ..... B31F 1/07

[52] U.S. Cl. ..... 101/32; 101/27; 101/383; 269/7

[58] Field of Search ..... 101/12, 9, 16, 101/17, 27, 31, 32, 383, 486; 269/7, 58

[56] References Cited

U.S. PATENT DOCUMENTS

| | | | |
|---|---|---|---|
| 406,671 | 7/1889 | Sawyer . | |
| 995,537 | 6/1911 | Hertner et al. . | |
| 1,490,191 | 4/1924 | Allcutt . | |
| 2,246,795 | 6/1941 | Daniels | 101/383 |
| 2,339,158 | 1/1944 | Drake . | |
| 2,937,437 | 5/1960 | Cole et al. . | |
| 3,128,090 | 4/1964 | Andersen . | |
| 3,526,397 | 9/1970 | Verguson . | |
| 3,591,285 | 7/1971 | Hakogi | 101/32 |
| 3,790,152 | 2/1974 | Parsons . | |
| 3,866,667 | 2/1975 | Knight . | |
| 3,874,124 | 4/1975 | Morgan et al. . | |
| 3,971,275 | 7/1976 | Mach | 83/635 |
| 4,509,673 | 4/1985 | Schmidt et al. . | |
| 4,629,378 | 12/1986 | Parsons . | |
| 5,517,910 | 5/1996 | Skahan | 101/27 |
| 5,562,796 | 10/1996 | Ertel . | |

*Primary Examiner*—Eugene H. Eickholt
*Attorney, Agent, or Firm*—Banner & Witcoff, Ltd.

[57] ABSTRACT

The invention includes a self-aligning die platen assembly for use with a cooperating die platen assembly to form a die set. The self-aligning die platen assembly comprises a die shoe and a platen having a working face for operational cooperation with a corresponding working face of the cooperating die platen assembly. The platen is mounted in the die shoe and has a freely rockable condition therein which permits the platen to be moved into an aligned operational position in which its working face conforms to the corresponding working face of the cooperating die platen when the assemblies are closed. The die platen assembly also includes a locking element for securely maintaining the self-aligning platen in the operational position. A preferred locking device includes a low temperature melting alloy.

21 Claims, 2 Drawing Sheets

METHOD AND APPARATUS FOR ALIGNING DIE STAMPING PRESS PLATENS

BACKGROUND OF THE INVENTION

The present invention relates to an improved self-aligning die platen assembly for use in die stamping presses to facilitate the operation of such devices.

Die stamping machines perform various operations on a number of substrates including paper, plastic, metal film and ceramics. These stamping machines include mutually cooperable die assemblies or a die assembly in cooperation with an anvil platen. A stamping machine must undergo a series of preparatory set-up steps directed to obtaining parallelism to the extent possible to achieve conformity between corresponding working faces of the die assemblies or die assembly and platen. In general, the preparatory steps needed to achieve the parallel conforming relationship involve preliminary placement of the die, followed by numerous trial runs and adjustments of the die until parallelism between corresponding working faces is achieved. This process is time consuming as well as requiring considerable operator skill. Nevertheless, no matter the stamping machine used, it is necessary that the corresponding working faces of the die assemblies or the die assembly and platen be in a parallel conforming relationship.

For example, in the case of a die being used against a cooperating flat platen working face, it is not uncommon for portions of the operating edge of the die's working face to be of greater height than other portions. Therefore, when the die is moved toward a workpiece positioned on the cooperating platen, those portions of the working face of the die which are highest engage the workpiece before the other portions of the working face. As a result, the cut, crease press, lamination or perforating line is not uniform throughout the extent of the die.

One manner of aligning the working faces of the platen and a die used in the prior art involves using a spring loaded platen and an epoxy. The springs are attached to the under side of the platen and placed within a die shoe reservoir. The reservoir is then backfilled with an epoxy that is cured while the press is held in a closed position. The epoxy fills in around the springs and holds the springs and platen in alignment. A major drawback is that once the epoxy has been set, the platen can not be repositioned without destroying it. In order to reposition the platen, the platen, springs and epoxy must all be removed from the die shoe and a new platen having new springs and new epoxy must be provided. This does not allow for repetitive, economical platen alignment with different cooperating platen assemblies.

U.S. Pat. No. 5,517,910 to Skahan, incorporated herein by reference, suggests a self-leveling, rocking die platen for a die stamping press having a piston which rocks within a fluid chamber for the self-leveling of the die platen assembly. Skahan discloses that the piston moves within the fluid so that each time the die assembly is closed, the platen moves to achieve parallelism with the upper platen assembly. This platen requires the user to wait until the piston has rocked into position before the operation of the press can be carried out. Also, the piston is never secured relative to the shoe. Instead, it is free to rock and rotate relative to the shoe when the press is in an open position. Furthermore, the hydraulic fluid used to support Skahan's piston and platen compresses under high loads. This compression allows the platen to move out of position with the cooperating platen, resulting in inconsistent cuts, folds or perforations.

There is a decided need in the art for an improved die set which maintains alignment between corresponding working faces of cooperating assemblies while permitting the assemblies to be reused for different operations without replacing expensive components.

It is an object of this invention to overcome the disadvantages of the prior art by providing an economical, reusable die set and a method of operating such die set.

SUMMARY OF THE INVENTION

Broadly defined, the present invention includes a self-aligning die platen assembly for use with a cooperating die platen assembly to form a die set. The self-aligning die platen assembly comprises a die shoe and a platen having a working face for operational cooperation with a corresponding working face of the cooperating die platen assembly. The platen is mounted in the die shoe and has a freely rockable condition therein which permits the platen to be moved into an aligned operational position in which its working face conforms to the corresponding working face when the assemblies are closed. The die platen assembly also comprises a locking element operatively associated with the platen. The locking element is selectively and repeatedly changeable between a first condition to maintain the platen locked in the operational position when the assemblies are opened and a second condition to release the platen to the freely rockable condition.

The locking element includes a material which is solid in the first condition and liquid in the second condition. More preferably, the material is a low temperature melting alloy.

The present invention also includes a method of aligning cooperating die platen assemblies having mutually opposed platens. One of the platen assemblies is self-aligning and has a normally rockable condition. The method includes closing the assemblies to move the self-aligning platen into an aligned operational position conformed to the opposed platen. The method also includes releasably securing the self-aligning platen while said assemblies are closed and opening the assemblies while securely maintaining the self-aligning platen in the operational position. The method further includes releasing the self-aligning platen from its operational position back to the rockable condition.

The self-aligning platen is secured by converting a material from a liquid state to a solid state and released by converting the material from a solid state to a liquid state. Preferably, the material is a low temperature melting alloy.

In a preferred embodiment the metal alloy is melted outside the cavity and then introduced into the cavity through the filling port. It is also contemplated that the cavity may be filled by pouring the alloy into the cavity. Further, the alloy may be placed within the cavity and then melted.

DETAILED DESCRIPTION OF THE PREFERRED EMBODIMENT

Figure 1:
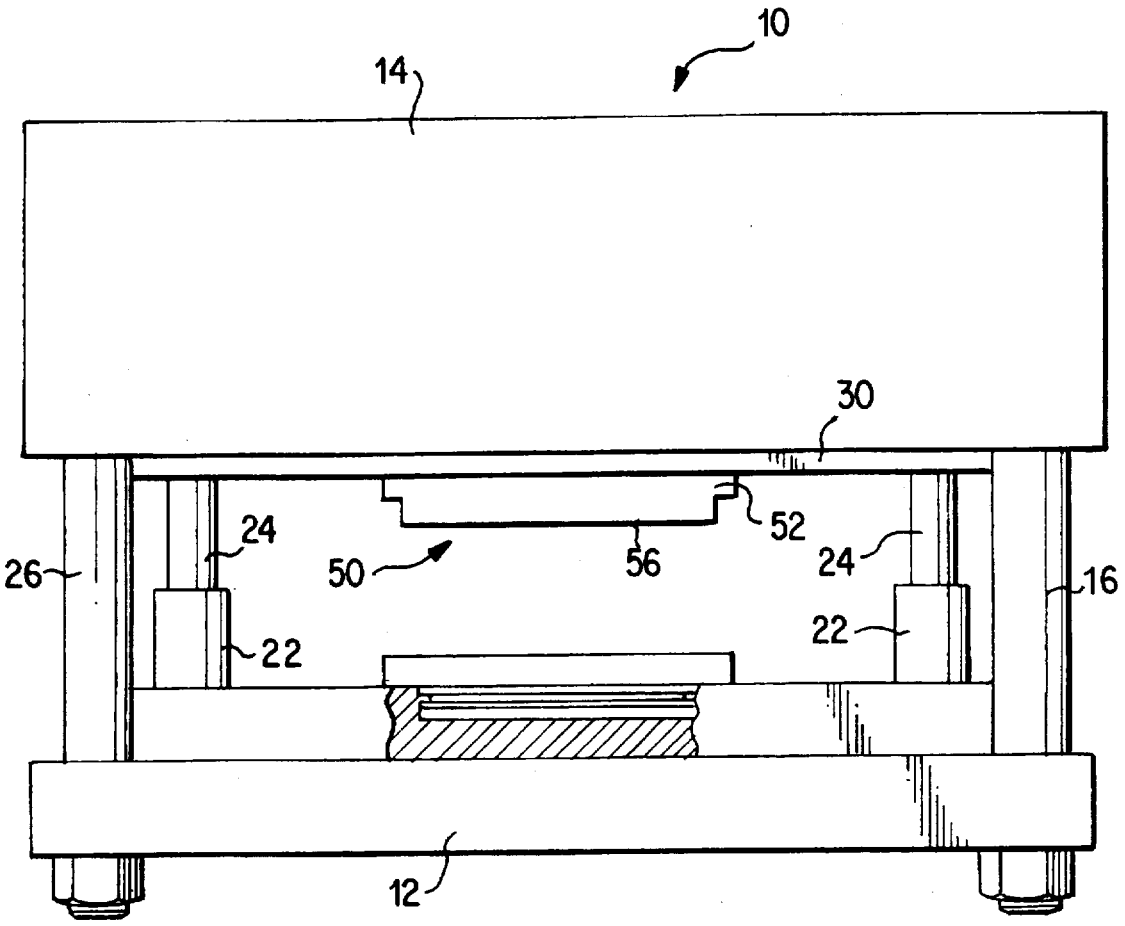
FIG. 1 is a front elevational view partially in section and illustrating a stamping press incorporating the preferred die set construction of the present invention.

FIG. 1 shows a stamping press 10. The press includes a lower bolster 12 as well as an upper, opposed press head 14.

The bolster 12 and head 14 are interconnected by conventional means such as columns 16.

Figure 2:
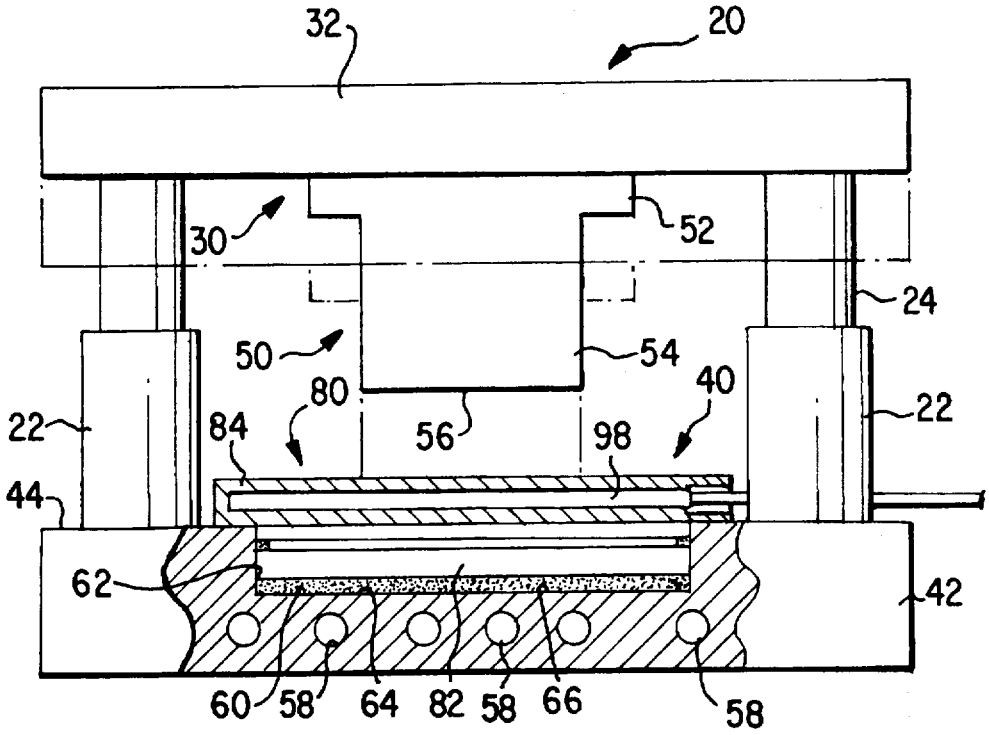
FIG. 2 is a front view partially in section, illustrating the die set.

As best seen in FIG. 2, the stamping press 10 includes an operating die set 20. The die set 20, for the purpose of illustrating the advantages of this invention, is shown as having an upper die platen assembly 30 having a die 50, as well as a lower self-aligning die platen assembly 40. It is to be understood that the principles of this invention are applicable to die sets utilizing different types of dies and upper die shoe assemblies.

The assemblies 30, 40 are interconnected and supported for shifting movement of the upper die platen assembly 30 by the upright, shouldered bushings 22. Upper die platen assembly 30 is essentially conventional and is in the form of an elongated, substantially rectangular upper plate mounted on posts 24 which are received in the bushings 22.

As shown in FIG. 1, the die platen assembly 30 includes a die 50 fixedly mounted to the lower face of plate 32. The die 50 includes a mount 52 secured to plate 30 and a working face 56 for operatively contacting the substrate and the lower assembly 40.

Figure 4:
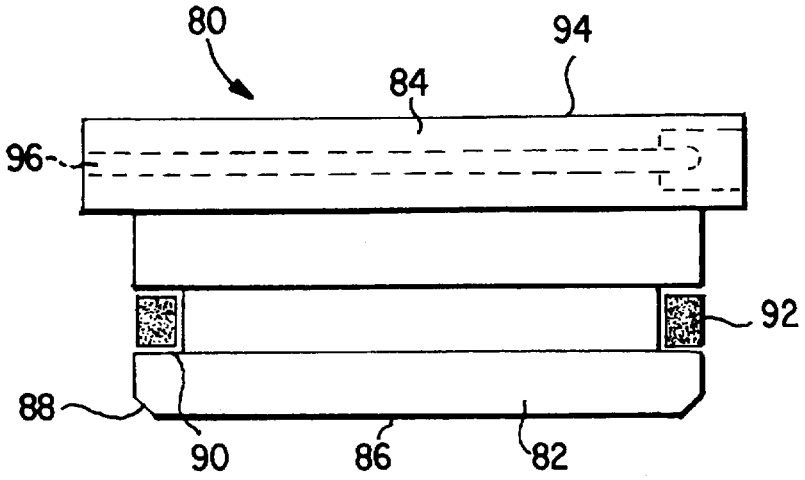
FIG. 4 is a side view of the platen and its piston.

Lower platen assembly 40 aligns platen working face 94 with working face 56 of die 50 by moving working face 94 into an operational position in which parallelism exists between the working faces 56, 94. The lower assembly 40 includes a substantially rectangular metallic die shoe 42 having an upper surface 44. Bushings 22 are supported by shoe 42. The center of shoe 42 includes a downwardly extending cylindrical cavity 60. The cavity 60 includes a circular cross section, but could have any appropriate cross section. Cavity 60 has vertically extending sidewall 62 and lower surface 64. As best shown in FIG. 4, cavity 60 is also provided with an aperture 70 in sidewall 62. Filling port 72 extends from an outer surface of shoe 42 to the aperture 70. A low temperature melting alloy 66 is introduced into the cavity through filling port 72.

Lower platen assembly 40 also includes a self-aligning platen subassembly 80 which is mounted within cavity 60 so that the subassembly 80 can freely rockably move relative to cavity 60. The subassembly 80 includes a lower piston 82 having a bottom face 86 and a vertical sidewall 88 having a peripheral recess 90. A pressure seal 92 is positioned within the recess 90 for sealingly engaging with the sidewall 62 of cavity 60 in order to maintain the alloy 66 within the cavity 60.

The subassembly 80 further includes an upper platen 84 which is affixed to piston 82 by conventional means such as a series of bolts (not shown). The platen 84 includes a working face 94 for supporting a workpiece and for operationally cooperating with the working face 56 of die 50. When the platen assemblies are closed, working face 94 and working face 56 are moved toward each other causing the platen 84 of subassembly 80 to rock within cavity 60 so that working face 94 conforms to the configuration of working face 56 when the closure is complete, thereby achieving parallelism between the working faces with the platen 84 in its aligned operational position.

While in a solid state, the alloy 66 locks the platen 84 in the aligned operational position and thereby maintains parallelism between working faces 56, 94. When converted to its liquid state, the alloy releases platen 84 and allows it to rock so that a new operational position can be established. Parallelism can be achieved multiple times between the same or different working faces by selectively convening the alloy 66 from a liquid state to a solid state and back to a liquid state.

The low temperature melting alloy 66 locks the platen 84 in its aligned operational position when the working faces 56, 94 have achieved parallelism. The alloy preferably has a melting temperature between 100 and 1000 degrees Fahrenheit, and more preferably between 104 and 750 degrees Fahrenheit. Most preferably, the melting temperature is between 117 and 302 degrees Fahrenheit. The low melting temperature makes the alloy 66 easy to handle and does not require elaborate and extensive melting equipment.

The volume of the alloy 66 does not experience substantial, if any, change when it solidifies from its liquid state to its solid state. Also, the alloy exhibits high compressive strength which allows it to bear the heavy loads applied by such devices as die and laminating presses. Generally, the alloy is transformed from a solid to a liquid using heat. The alloy is returned to its solid state by cooling the liquid. The alloy can be repeatedly transformed between a liquid state and a solid state without harming the alloy.

A preferred material is a fusible low temperature melting alloy. Many such materials are commercially available. One acceptable such alloy is available from the Cerro Metal Products Company under the trade name "Cerrobend". This alloy comprises 50 percent bismuth, 26.7 percent lead, 13.3 percent tin and 10.0 percent cadmium and has a melting temperature of about 158 degrees Fahrenheit. The "Cerrobend" alloy maintains its volume within cavity 60 and when in a liquid state allows the platen to rock.

Some acceptable alloys contain indium. Under certain conditions, other materials such as thermoplastics and waxes may be used.

Figure 3:
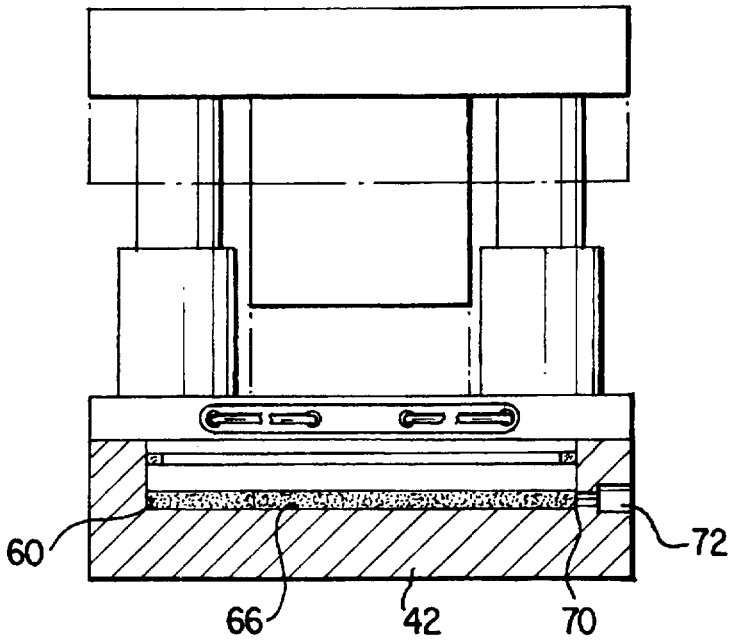
FIG. 3 is an end view partially in section of the die set depicted in FIG. 2.

The use of illustrative die set 20 carried by press 10 is best shown in FIG. 2. FIGS. 2 and 3 show the assemblies 30, 40 being moved from an open position, solid lines, to a closed position, phantom lines, to create desired cuts, crease lines, perforations, laminations or other alterations in the workpiece. As the assemblies 30, 40 are brought into the closed position, the platen 84 rocks relative to cavity 60 while working face 94 operationally engages the work piece and conforms to the corresponding die working face 56, thereby establishing parallelism between the faces. The platen 84 is then releasably secured in an operating position so that parallelism is maintained when the assemblies 30, 40 are opened during operation of the press 10. The operational position of the platen 84 can be repeatedly adjusted as discussed above. The vertical rest position of platen 84 can be altered by the amount of liquid metal 66 introduced within cavity 60.

A platen subassembly 80 may be mounted within upper platen assembly 30 as part of press head 14. Alternatively, a series of smaller piston and platen subassemblies 80 may be provided, either as a part of lower bolster 12 or incorporated into the upper platen assembly 30, in order to cover larger platen areas, as for example in presses having a platen area in the order of 20×24 inches. In addition, the platen 84 has a plurality of elongated passageways 96 designed to receive heating coils 98 which are provided for heating the platen 84 and the low temperature alloy 66 within the cavity 60. Alternatively or additionally, die shoe 42 may be provided with heaters 58 for melting the alloy 66.

Many possible embodiments of the invention may be made without departing from the scope thereof which is defined by the appended claims. It is to be understood that all the matter set forth herein or shown in the drawings is illustrative and not limiting to the present invention. It will be understood that certain features and subcombinations have utility and may be employed without reference to other features or subcombinations. The self-adjusting platen assembly may be used with different types of presses and is not limited to the presses discussed above.

I claim:

1. A self-aligning die platen assembly for use with a cooperating die platen assembly to form a die set, said self-aligning die platen assembly comprising:

a die shoe;

a platen having a working face for operational cooperation with a corresponding working face of the cooperating die platen assembly when in closed relationship therewith;

said platen being mounted in said die shoe and having a freely rockable condition therein to permit said platen to be moved into an aligned operational position in which its working face conforms to the corresponding working face when the assemblies are closed; and a locking element operatively associated with said platen and being selectively and repeatedly changeable between a first condition to maintain said platen locked in said operational position when the assemblies are opened and a second condition to release said platen to said freely rockable condition.

2. The self-aligning die assembly of claim 1 wherein said locking element is selectively heated and cooled to change it between said first and second conditions.

3. The self-aligning die assembly of claim 1 wherein said locking element comprises a material which is solid in said first condition for maintaining said platen in said locked position and liquid in said second condition for releasing said platen to said freely rockable condition.

4. The self-aligning die assembly of claim 3 wherein said material is an alloy having a low temperature melting point.

5. The self-aligning die assembly of claim 4 wherein said alloy has a melting temperature within the range of 100 to 1000 degrees Fahrenheit.

6. The self-aligning die assembly of claim 5 wherein said alloy has a melting temperature within the range of 104 to 750 degrees Fahrenheit.

7. The self-aligning die assembly of claim 6 wherein said melting temperature is within the range of 117 to 302 degrees Fahrenheit.

8. The self-aligning die assembly of claim 7 wherein said melting temperature is about 158 degrees Fahrenheit.

9. The self-aligning die assembly of claim 3 wherein said material substantially maintains its volume from a liquid state to a solid state.

10. The self-aligning die assembly of claim 4 wherein said material substantially maintains its volume from a liquid state to a solid state.

11. The self-aligning die assembly of claim 4 wherein said alloy includes bismuth.

12. A method of aligning cooperating die platen assemblies having mutually opposed platens, the platen in one of said assemblies being self-aligning and having a normally rockable condition, comprising the steps of:

closing said assemblies to move said self-aligning platen into an aligned operational position conformed to the opposed platen;

releasably securing said self-aligning platen while said assemblies are closed;

opening said assemblies while maintaining said self-aligning platen secured in said operational position; and releasing said self-aligning platen from said operational position to said rockable condition.

13. The method of claim 12 further comprising operatively engaging said self-aligning platen with a material in a liquid state which permits said self-aligning platen to rock in said rockable condition;

converting said material to a solid state to secure said self-aligning platen in said operational position; and releasing said platen to said rockable condition by reconverting said material to a liquid state.

14. The method of claim 12 wherein said self-aligning platen is rockable in a material in a liquid state, said releasably securing step includes converting said material to a solid state; and said releasing step includes converting said material from a solid state to a liquid state.

15. The method of claim 13 wherein said material comprises an alloy having a low temperature melting point.

16. The method of claim 15 wherein said alloy has a melting temperature within the range of 100 to 1000 degrees Fahrenheit.

17. The method of claim 16 wherein said alloy has a melting temperature within the range of 104 to 750 degrees Fahrenheit.

18. The method of claim 17 wherein said meting temperature is within the range of 117 to 302 degrees Fahrenheit.

19. The method of claim 18 wherein said meting temperature is about 158 degrees Fahrenheit.

20. The method of claim 13 wherein said material substantially maintains its volume from said liquid state to solid state.

21. The method of claim 13 wherein said material includes bismuth.

* * * * *